US005432400A

United States Patent [19]

Spaulding et al.

[11] Patent Number: 5,432,400

[45] Date of Patent: * Jul. 11, 1995

[54] LAMP HAVING INTERFERENCE-FIT METALLIC BASES

[75] Inventors: Dennis D. Spaulding, Methuen, Mass.; Nicholas W. Brett, Fremont, N.H.

[73] Assignee: GTE Products Corporation, Danvers, Mass.

[ * ] Notice: The portion of the term of this patent subsequent to Oct. 19, 2010 has been disclaimed.

[21] Appl. No.: 951,521

[22] Filed: Sep. 25, 1992

[51] Int. Cl.[6] ..... H01J 5/48

[52] U.S. Cl. ..... 313/318.02; 439/612; 439/617; 445/26

[58] Field of Search ..... 313/318, 493, 51, 624, 313/625; 439/611, 612, 617, 619; 445/22, 26, 27

[56] References Cited

U.S. PATENT DOCUMENTS

| | | | |
|---|---|---|---|
| 2,386,190 | 10/1945 | Betts | 176/32 |
| 2,993,191 | 7/1961 | Pietzsch et al. | 339/145 |
| 4,012,658 | 3/1977 | Vause | 313/318 |
| 4,221,453 | 9/1980 | Wagener | 339/149 R |
| 4,536,676 | 8/1985 | Maruyama et al. | 439/611 |
| 5,010,272 | 4/1991 | Eckhardt et al. | 313/318 |
| 5,254,025 | 10/1993 | Spaulding | 439/617 |

FOREIGN PATENT DOCUMENTS

| | | | |
|---|---|---|---|
| 0212842 | 12/1983 | United Kingdom | 313/318 |

*Primary Examiner*—Richard Hjerpe
*Assistant Examiner*—Chanh Nguyen
*Attorney, Agent, or Firm*—Carlo S. Bessone

[57] ABSTRACT

A lamp including a glass envelope having a base fitted at each end portion thereof. Each lamp base includes a metallic base shell having an annular flange. The annular flange is heated prior to fitting over the end portion of the envelope so as to increase the inner flange diameter. Cooling of the annular flange after fitting reduces the flange diameter thereby providing an interference fit with the end portion. The lamp base is retained on the end portion without the need for basing cement. In order to accommodate variations in the diameter of the lamp seals, an annular rib is formed on the inner surface of the flange. After cooling, the annular rib forms an interference fit with the lamp end portion.

11 Claims, 3 Drawing Sheets

LAMP HAVING INTERFERENCE-FIT METALLIC BASES

CROSS-REFERENCE TO A RELATED APPLICATION

This application discloses, but does not claim, inventions which are claimed in U.S. Ser. No. 07/951,509 (now U.S. Pat. No. 5,254,025) filed concurrently herewith and assigned to the Assignee of this application.

FIELD OF THE INVENTION

This invention relates in general to bases for electric lamps.

BACKGROUND OF THE INVENTION

In the manufacture of lamps, the lamp envelope is usually provided with at least one base. Generally, a lamp base comprises a metallic (e.g., aluminum) or plastic shell secured to an end portion of the lamp envelope. In the case of a metallic base shell, at least one insulating disk is fixed in the shell for carrying one or more hollow base pins or contacts into which the lamp lead wires are electrically secured. The lamp is supported by one or more holders or sockets into which the lamp bases extend for connection to a source of electrical energy.

Typically, such lamp bases are secured to the end portion of the lamp envelope by means of a cement which is applied to the inside surface of the base shell. A sufficient quantity of cement is used to fill in the gap between the lamp seal and the annular wall of the base. During manufacturing, each base is first fitted loosely onto a respective end portion of the lamp envelope. Thereafter, the cement is cured (e.g., by heating) which allows the base to adhere to the lamp bulb and withstand industry torque requirements.

While the above technique of securing the lamp base by means of a suitable cement has been employed successfully in many lamp families including fluorescent, it has been found that certain disadvantages do exist. For example, the cement not only adds cost to the lamp but also requires the need for a separate process of applying the raw cement to the base shell. Moreover, while present manufacturing facilities using such a technique are equipped with machines which dispense cement, these machines require constant monitoring and periodic mechanical and electrical maintenance. Another disadvantage is the curing process of the cement wherein indirect natural gas flame heat is used to cure the basing cement after the base is fitted to the end of the lamp. The temperatures required to cure the cement sometimes cause damage in the seal area of the lamp envelope. In addition, the machinery needed to provide the heat for curing not only requires periodic maintenance but also takes up valuable floor space in the production line.

Various alternatives for securing the base to the lamp end with little or no cement (or other type of adhesive) have been proposed in the past. For example, U.S. Pat. No. 2,993,191, which issued on Jul. 18, 1961 to Pietzsch et al, discloses a base for an electric discharge lamp wherein the base is constructed from resin having a modulus of elasticity which is greater than 5,000 kg./cm.$^2$ and as high as about 19,000 kg./cm.$^2$. The resin has a breaking dilation of more than 50% and as high as about 230% and has an initial softening temperature of as low as about 150° Celsius and as high as about 210° Celsius. In one embodiment, the base of Pietzsch et al is positioned with the annular wall adjacent to the trough of a bulb end which has been heated to about 330° to 350° Celsius. As a result, the base material melts and occupies the trough or channel and by reason of the character of the material of which the base is composed, adheres to the surface of the glass bulb. Alternatively, the base may be pressed against the bulb end to cause an annular rib or reinforcement to snap over the bead or rim and into a trough or channel of the bulb without heating the bulb neck.

U.S. Pat. No. 4,221,453, which issued to Wagener on Sep. 9, 1980, discloses a socket capping (i.e., base) for a fluorescent lamp. The base comprises a frontal portion, contact pins electrically connected to the connecting wires, at least one drop of glue which dries at room temperature, and an annular wall extending circumferentially from and perpendicular to the frontal portion. The annular wall has at least two, equally circumferentially spaced knobs protruding inwardly. The base is formed from an elastic, bendable thermoplastic material so that when the base is fitted to the tube over the end portions, the annular wall elastically deforms and the knobs slide over the collar and snap into the groove of the lamp end portion. To safeguard against rotary movement of the base relative to the bulb, the base is formed with radial ribs to be disposed into notches provided in the bulb neck.

While the bases described in the above patents appear to be satisfactory from a functional standpoint, it is believed that unanticipated production or other related problems (e.g., material cost) may explain why such bases have not been commercially successful. Accordingly, it would be advantageous to provide other viable alternatives.

SUMMARY OF THE INVENTION

It is, therefore, an object of the present invention to obviate the disadvantages of the prior art.

It is still another object of the invention to provide an improved base for a lamp.

It is another object of the invention to provide a base which can easily be secured to the lamp end without the need for basing cement or other type of adhesive.

It is still another object of the invention to provide a base which does not need special notching of the bulb neck in order to prevent rotary movement of the base relative to the bulb.

These objects are accomplished in one aspect of the invention by the provision of a lamp (i.e., an incandescent lamp, a fluorescent lamp, a high intensity discharge lamp, etc.) comprising a glass envelope having at least one end portion. The end portion or portions have an annular groove and a terminating annular seal having a predetermined diameter. Disposed at the end portion is a lamp base comprising a metallic base shell having an annular flange with a relatively smooth inner surface, insulating means secured to the base shell, and base pin or contact means mounted on the insulating means for connection to a source of power. The inner diameter of the annular flange is such that when the base shell is heated prior to fitting of the annular flange over the end portion the diameter of the annular flange increases to an expanded diameter. After the annular flange is cooled following fitting, the annular flange forms an interference fit with the end portion so as to retain the lamp base on the end portion in a cement-free manner.

In accordance with further teachings of the present invention, the annular flange includes an annular rib on the inner surface thereof. The inner diameter of the annular rib is such that when the annular flange is heated prior to fitting of the annular flange over the end portion, the inner diameter of the annular rib increases to an expanded diameter. After the annular flange is cooled following fitting, the annular rib forms an interference fit with the end portion so as to retain the lamp base on the end portion in a cement-free manner.

These objects are accomplished in another aspect of the invention by the provision of a method for manufacturing a lamp. The method comprises the steps of providing an hermetically sealed glass envelope having at least one end portion which includes an annular groove and a terminating annular seal; providing a lamp base comprising a metallic base shell having an annular flange with an inner surface, insulating means secured to the base shell, and base pin or contact means mounted on the insulating means; heating the annular flange to a predetermined temperature so as to increase the predetermined minimum diameter of the annular flange to an expanded diameter; thereafter, fitting the annular flange over the end portion; and cooling the annular flange so that the inner surface thereof forms an interference fit with the end portion so as to retain the lamp base on the end portion in a cement-free manner.

In accordance with still further teachings of the present invention, the method for manufacturing the lamp includes the step of forming an annular rib on the inner surface of the annular flange and fitting the annular flange over the end portion so that the annular rib is adjacent to the annular groove and the annular seal.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalitles and combination particularly pointed out in the appended claims.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
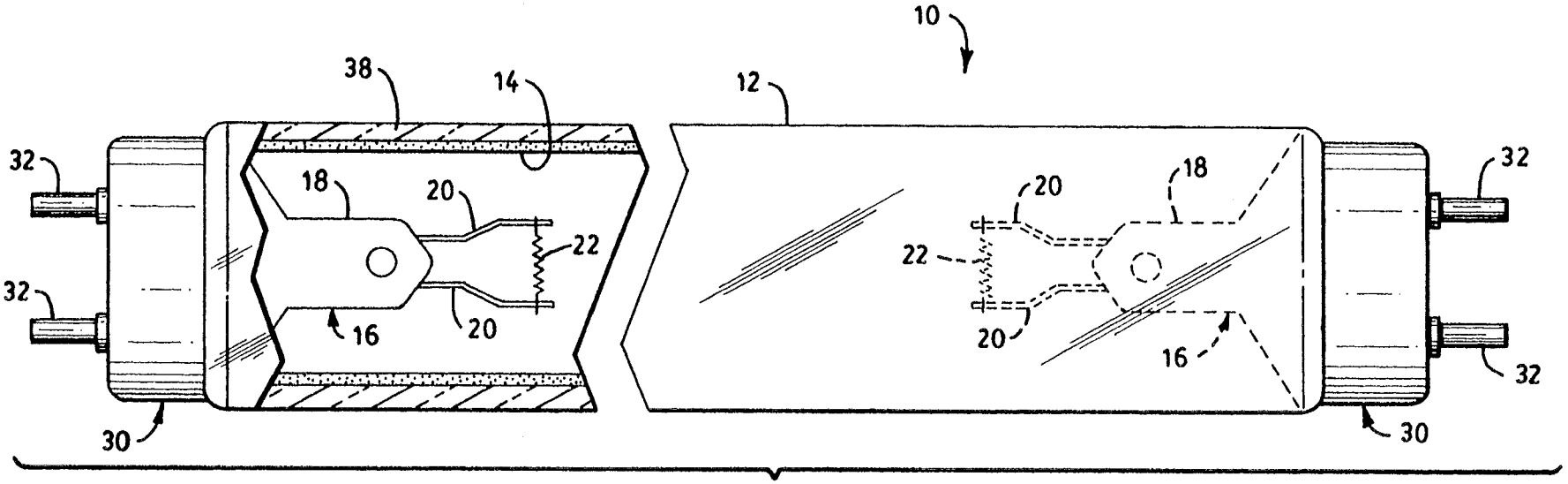
FIG. 1 represents a front elevational view, partially broken away, of an arc discharge lamp made in accordance with the teachings of the present invention.
Figure 2:
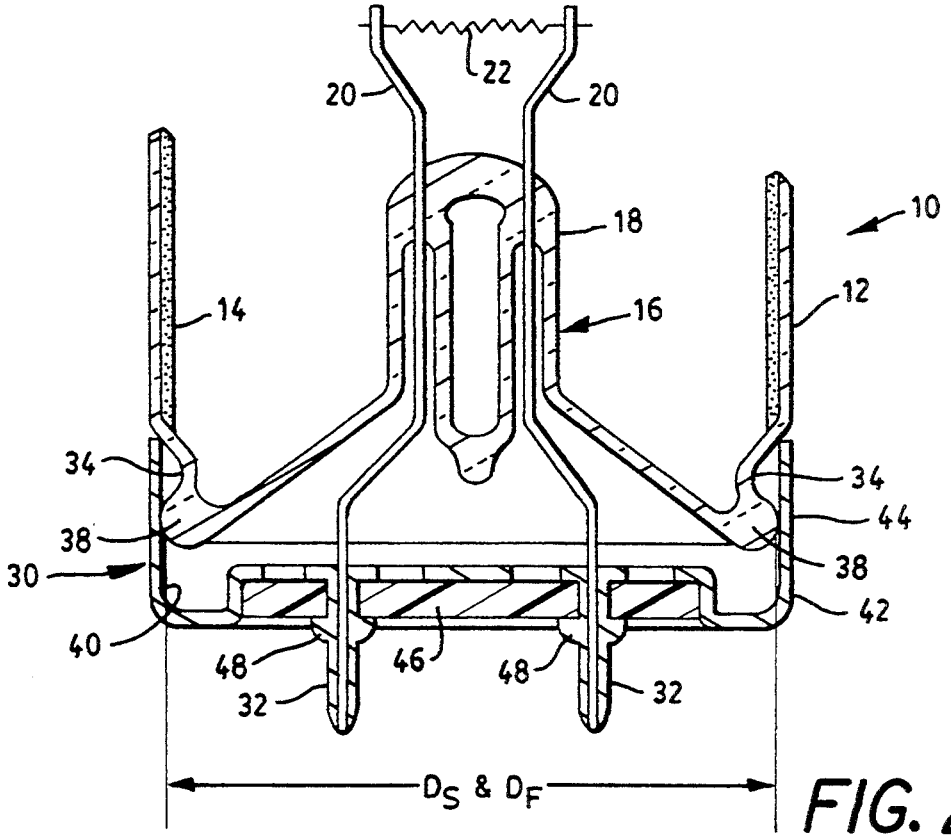
FIG. 2 is an enlarged sectional view of one end of the arc·discharge lamp shown in FIG. 1 illustrating one embodiment of an improved lamp base.

Referring now to the drawings with greater particularity, there is shown in FIGS. 1 and 2 a lamp 10 (i.e., a fluorescent) comprising a tubular vitreous or glass envelope 12 that is provided with an inner coating of phosphor 14 and is hermetically sealed at each end by a glass mount 16. Each mount 16 includes a stem press 18 within which a pair of lead wires 20 are sealed. A thermionic electrode 22 is mounted on the inner ends of lead wires 20 within the tubular glass envelope 12. Each thermionic electrode 22 comprises a tungsten coil coated with an emissive material of alkaline earth oxides.

In accordance with standard lamp-making practice, the envelope 12 is filled with a suitable starting gas and also doped with mercury to provide an ionizable medium within the sealed envelope which permits an electric discharge to pass between the thermionic electrodes.

As shown more particularly in the enlarged sectional view of one end of the fluorescent lamp 10 illustrated in FIG. 2, each of the end portions of the lamp envelope 12 includes an annular groove 34 which terminates at an annular rim or seal 38 which has a diameter $D_s$. Each of the sealed end portions of envelope 12 are fitted with a base 30 that includes a pair of axially-extending metal base pins 32 or other form of contacts which serve as terminals for the lamp 10 and are adapted, by virtue of their spacing and dimensions, to permit the lamp to be inserted into the socket components of a lighting fixture and be operated from a suitable electrical power supply. Each lead wire 20 extends through a stem press 18 in mount 16 to a respective metal base pin 32.

Base 30 includes a metallic base shell 42 having an annular flange 44 with an inner diameter $D_f$. Annular flange 44 has a relatively smooth inner surface 40 in the embodiment of FIG. 2. Surface 40 in FIG. 2 is smooth in the sense that this surface is free of any bumps or other protrusions. When the base 30 of FIG. 2 is secured to the lamp end portion in a manner to be described below, the inner surface 40 of the annular flange 44 contacts annular seal 38. Base shell 42 is formed of a suitable metal such as aluminum, which has a modulus of elasticity which is between $6.32\times10^5$ kg/cm$^2$ and $4.03\times10^6$ kg/cm$^2$. Aluminum has a breaking dilation of 14% minimum and a melting temperature of 660° Celsius.

An oval-shaped disk 46 of insulating material is secured to base shell 42. A pair of base pins 32 are received in registering apertures formed in the insulating disk 46. As illustrated in FIG. 2, each of the base pins 32 are provided with an upset collar portion 48 engaging the lower surface of disk 46 and having their inner ends swaged or riveted into contact with the upper surface of disk 46 thus rigidly securing the pins in position.

While the base 30 is shown including two base pins, any number of pins may be used depending upon the type of lamp being manufactured. Also, while only one insulating disk is used in the base illustrated in FIG. 2, it is understood that each base pin may be mounted on separate insulating disks.

At room temperature (i.e., 77° F.), the inner diameter $D_f$ of the annular flange 44 prior to fitting over the lamp end portion is slightly smaller than the annular seal diameter $D_s$. During lamp manufacturing and prior to fitting the lamp base over the end portion, the annular flange 44 is heated to a temperature of, for example, 500° F. to 600° F. In response to the heat, the inner diameter $D_f$ of the annular flange 44 increases to an expanded diameter and allows the annular flange 44 to easily slide over the annular seal 38. Thereafter, the annular flange 44 of the base shell 42 is allowed to cool, whereupon annular flange 44 contracts to its initial diameter $D_f$ causing formation of an interference fit between the inner surface 40 of annular flange 44 and the lamp end portion. It has been discovered that this interference fit alone is sufficient to secure the lamp base to the lamp end portion. Bases fitted in this manner passed prescribed torsion tests. No cements, glues or other adhesives were needed.

The base of FIG. 2 is particularly suited to lamps wherein the shape of the annular seal and, more particularly, the outer diameter is precisely controlled as is the case where the annular seal is formed in a molded-type operation.

In a typical but non-limitative example of an arc discharge lamp in accordance with the teachings of the above embodiment, the lamp included a tubular glass envelope having an outer diameter of 1.474 inches. One of the lamp end portions contains an annular seal having an outer diameter of 1.348 inches. The base includes an aluminum base shell having an annular flange with an inner diameter (at room temperature and prior to fitting) of 1.338 inches. The annular flange is heated to a temperature of 550° F. whereupon the inner diameter of the annular flange increases to 1.346 inches. Thereafter, the heated annular flange is fitted over the end portion of the lamp and allowed to cool. Upon cooling, the inner surface of the annular flange contacts the annular lamp seal and forms an interference fit.

Figure 3:
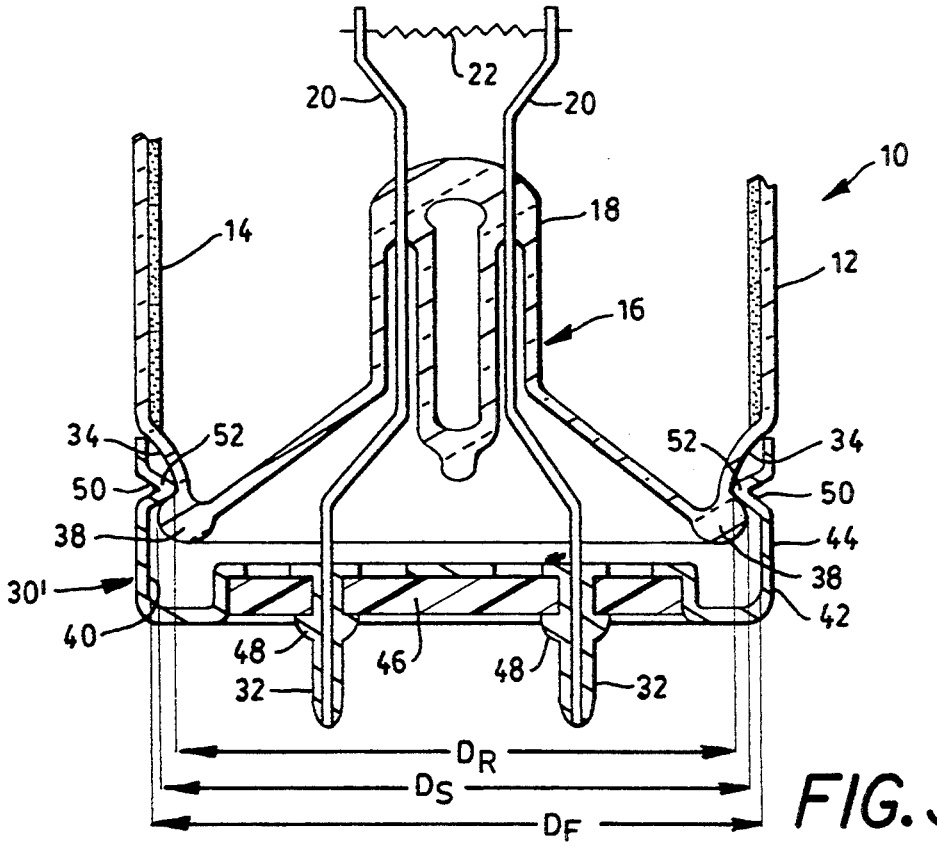
FIG. 3 is an enlarged sectional view of one end of an arc discharge lamp illustrating another embodiment of an improved lamp base wherein an annular rib is formed on the inner surface of the annular flange.

Referring next to FIG. 3, there is shown a lamp base 30' according to another embodiment of the present invention, wherein similar constituent members as those in FIG. 2 are denoted by the same reference numerals.

In order to better accommodate normal variations in the diameter of lamp seals, the annular flange 44 includes a groove or channel 50 formed in the outer surface of the annular flange 44 which provides an annular rib 52 on the inner surface of the annular flange 44.

Groove 50 and annular rib 52 may be formed by placing the base on a split, spring-loaded mandrel having an annular groove. The annular groove in the mandrel has a depth equal to the maximum intended height of annular rib. A clamshell clamp with a tooth corresponding to the maximum rib height contacts the annular flange at the intersection of the tooth and the annular groove formed in the mandrel. The depth of the groove formed in the base flange (and consequently the height of the annular rib in the base flange) is controlled by a force gauge or a linear distance sensor.

Alternatively, the groove and annular rib in the base flange may be formed manually by using a hand tool with a tooth formed in one leg. The radius of the tooth is equal to the outer diameter of the base flange. A groove formed in the other leg of the tool to receive the tooth has the desired shape of the annular rib.

Figure 4A:
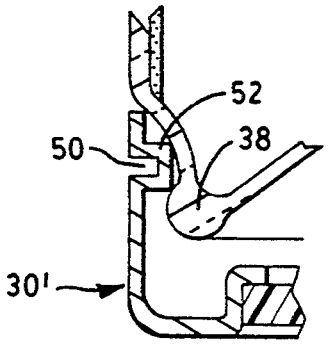
FIGS. 4A, 4B and 4C are enlarged sectional views of an arc discharge lamp illustrating alternative embodiments of an improved lamp base having an annular rib.
Figure 4B:
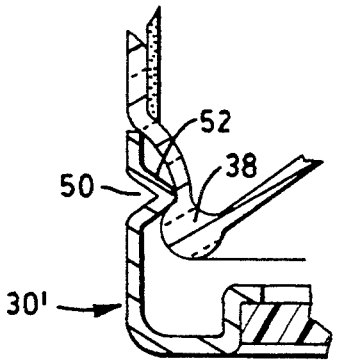
Figure 4C:
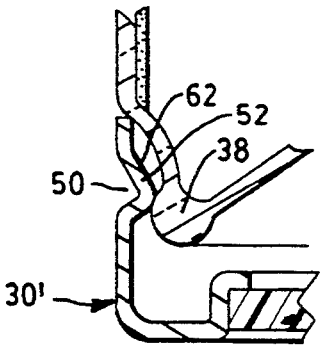

It is to be understood that the cross-sectional shape of the annular rib 52 may differ from that which is shown in FIG. 3. For example, the cross-sectional shape of rib 52 may be square (FIG. 4A), triangular (FIG. 4B) or have a leading edge 62 tapered at approximately 45° with respect to the base flange (FIG. 4C). Varying the cross-sectional shape of the annular rib 52 results in reduced fitting force and additional retention and anti-rotation forces.

At room temperature, the inner diameter $D_r$ of the annular rib 52 prior to fitting over the lamp end portion is slightly smaller than the annular seal diameter $D_s$. During lamp manufacturing and prior to fitting the lamp base over the end portion, the annular flange 44 is heated to a temperature of, for example, 500° F. to 600° F. As a result of heating the base flange, the inner diameter $D_r$ of the annular rib 52 increases to an expanded diameter which allows the annular rib 52 to slide over the annular seal 38 and into annular groove 34 adjacent to annular seal 38. The end portion of the lamp may be at room temperature or at an elevated temperature during base fitting. Thereafter, the annular flange 44 of the base shell 42 is allowed to cool, whereupon annular rib 52 forms an interference fit with the lamp end portion. Bases fitted in this manner passed prescribed torsion tests without the need for cement, glue or other form of adhesive.

The following TABLE illustrates typical rib dimensions for various lamp seal diameters $D_s$. The inner diameter $D_r$ of the annular rib is shown at 77° F. and 550° F. In each case, the inner diameter $D_f$ of the annular flange measured prior to the formation of the annular rib is equal to approximately 1.338 inches. Rib height in the second column is equal to $(D_f-D_r)/2$.

TABLE

| Avg. Seal Diameter $D_s$ | Approx. Rib Height | Inner Diam. Of Annular Rib @77° F. | Inner Diam. Of Annular Rib @550° F. |
|---|---|---|---|
| 1.34 | 0.011 | 1.315 | 1.322 |
| 1.33 | 0.014 | 1.310 | 1.317 |
| 1.32 | 0.019 | 1.300 | 1.307 |
| 1.31 | 0.024 | 1.290 | 1.297 |
| 1.30 | 0.029 | 1.280 | 1.287 |
| 1.29 | 0.034 | 1.270 | 1.277 |
| 1.28 | 0.039 | 1.260 | 1.267 |
| 1.27 | 0.044 | 1.250 | 1.257 |
| 1.26 | 0.049 | 1.240 | 1.247 |

After the base is fitted to the lamp end portion in the manner described above, changes to the height and/or shape of the annular rib may be made by the use of supplemental jaws containing a tooth. The circumferential radius of the jaws should approximate the smallest dimension of the annular groove in the base shell. Sufficient pressure is applied on the base shell by the jaws to deepen or reshape the existing annular groove and further force the annular rib against the lamp end portion. Such changes to the annular rib after base fitting further increases retention and anti-rotation forces.

There has thus been shown and described a lamp having an interference-fit metallic base. The base can easily be secured to the lamp end without the need for basing cement or other type of adhesive. The base can be used without the need for special notching of the bulb neck in order to prevent rotary movement of the base relative to the bulb.

While there have been shown and described what are at present considered to be the preferred embodiments of the invention, it will be apparent to those skilled in the art that various changes and modifications can be made herein without departing from the scope of the invention. For example, while the drawings illustrate a fluorescent lamp, it is understood that the teachings can also be applied to other lamp types. Therefore, the aim in the appended claims is to cover all such changes and modifications as fall within the true spirit and scope of the invention.

What is claimed is:

1. A lamp comprising:

a glass envelope having at least one end portion, said at least one end portion including a terminating annular seal having a predetermined diameter; and a lamp base disposed at said at least one end portion, said lamp base comprising a metallic base shell having an annular flange with a relatively smooth inner surface, insulating means secured to said base shell, and base pin or contact means mounted on said insulating means for connection to a source of power, said annular flange having a predetermined inner diameter such that when said base shell is heated prior to fitting said annular flange over said end portion, said predetermined inner diameter of said annular flange increases to an expanded diameter, whereupon after said annular flange is cooled following fitting, said relatively smooth inner surface of said annular flange forms an interference fit with said end portion so as to retain said lamp base on said end portion in a cement-free manner.

2. The lamp according to claim 1 wherein said lamp is a fluorescent lamp having a pair of end portions.

3. The lamp according to claim 1 wherein said metallic base shell is aluminum.

4. The lamp according to claim 1 wherein said insulating means comprises a single disk, said base pin or contact means comprising a pair of base pins mounted on said single disk.

5. A lamp comprising:

a cylindrical glass envelope having at least one end portion, said at least one end portion having an annular groove and a terminating annular seal, said annular seal having a predetermined diameter; and a lamp base disposed at said at least one end portion, said lamp base comprising a metallic base shell having an annular flange, insulating means secured to said base shell, and base pin or contact means mounted on said insulating means for connection to a source of power, said annular flange including an annular rib on the inner surface thereof, said annular rib having a predetermined inner diameter such that when said base shell is heated prior to fitting of said annular flange over said end portion, said predetermined inner diameter of said annular rib increases to an expanded diameter, whereupon after said annular flange is cooled following fitting, said annular rib forms an interference fit with said end portion so as to retain said lamp base on said end portion in a cement-free manner.

6. The lamp according to claim 5 wherein said lamp is a fluorescent lamp having a pair of end portions.

7. The lamp according to claim 5 wherein said metallic base shell is aluminum.

8. The lamp according to claim 5 wherein said insulating means comprises a single disk, said base pin or contact means comprising a pair of base pins mounted on said single disk.

9. The lamp according to claim 5 wherein the cross-sectional shape of said annular rib is square.

10. The lamp according to claim 5 wherein the cross-sectional shape of said annular rib is triangular.

11. The lamp according to claim 5 wherein the said annular rib has a leading edge tapered at approximately 45° with respect to said annular flange.

* * * * *